United States Patent [19]

Hartke

[11] 4,212,842

[45] Jul. 15, 1980

[54] CORROSION INHIBITION

[75] Inventor: Francis J. Hartke, Bridgeton, Mo.

[73] Assignee: Petrolite Corporation, St. Louis, Mo.

[21] Appl. No.: 561,605

[22] Filed: Mar. 24, 1975

[51] Int. Cl.[2] ..... C23F 15/00

[52] U.S. Cl. ..... 422/12; 422/13; 422/16; 252/391; 252/392

[58] Field of Search ..... 21/2.7 R, 2.5 R; 252/390, 8.55 E, 392; 148/6.14; 106/14; 260/404.5

[56] References Cited

U.S. PATENT DOCUMENTS

| | | | |
|---|---|---|---|
| 2,582,138 | 1/1952 | Lane et al. | 21/2.7 R X |
| 2,756,211 | 7/1956 | Jones | 260/404 |
| 2,839,465 | 6/1958 | Jones | 252/8.55 E |
| 2,901,438 | 8/1959 | Rogers | 21/2.7 R X |
| 2,965,577 | 12/1960 | Heimann | 21/2.7 R X |
| 3,003,955 | 10/1961 | Jones | 252/392 X |
| 3,107,221 | 10/1963 | Harrison et al. | 252/390 X |
| 3,447,891 | 6/1969 | Crawford | 21/2.7 R X |
| 3,458,453 | 7/1969 | Kautsky | 252/390 X |
| 3,649,167 | 3/1972 | Sawyer | 21/2.7 R X |
| 3,989,460 | 11/1976 | Merchant | 21/2.7R |

OTHER PUBLICATIONS

Handbook of Chemistry & Physics, 46th Ed., Weast et al., Ed. pp. C-517, C-529, C-110 (1964-1965).

*Primary Examiner*—Norman Yudkoff
*Attorney, Agent, or Firm*—Sidney B. Ring; Hyman F. Glass

[57] ABSTRACT

This invention relates to a process of inhibiting corrosion which comprises adding an aqueous soluble form of a normally insoluble corrosion inhibitor to an aqueous system which converts the soluble corrosion inhibitor to an insoluble form which coats the metal with a corrosion inhibiting film.

For example, a water insoluble heterocyclic amine used as a water soluble salt is dissolved in an aqueous system having a pH in excess of about 6 where the heterocyclic amine itself, i.e., in non-salt form, comes out of solution as a stable, fine dispersion which coats the metal with a uniform and tenacious corrosion inhibiting film.

16 Claims, 3 Drawing Figures

CORROSION INHIBITION

Figure 1:
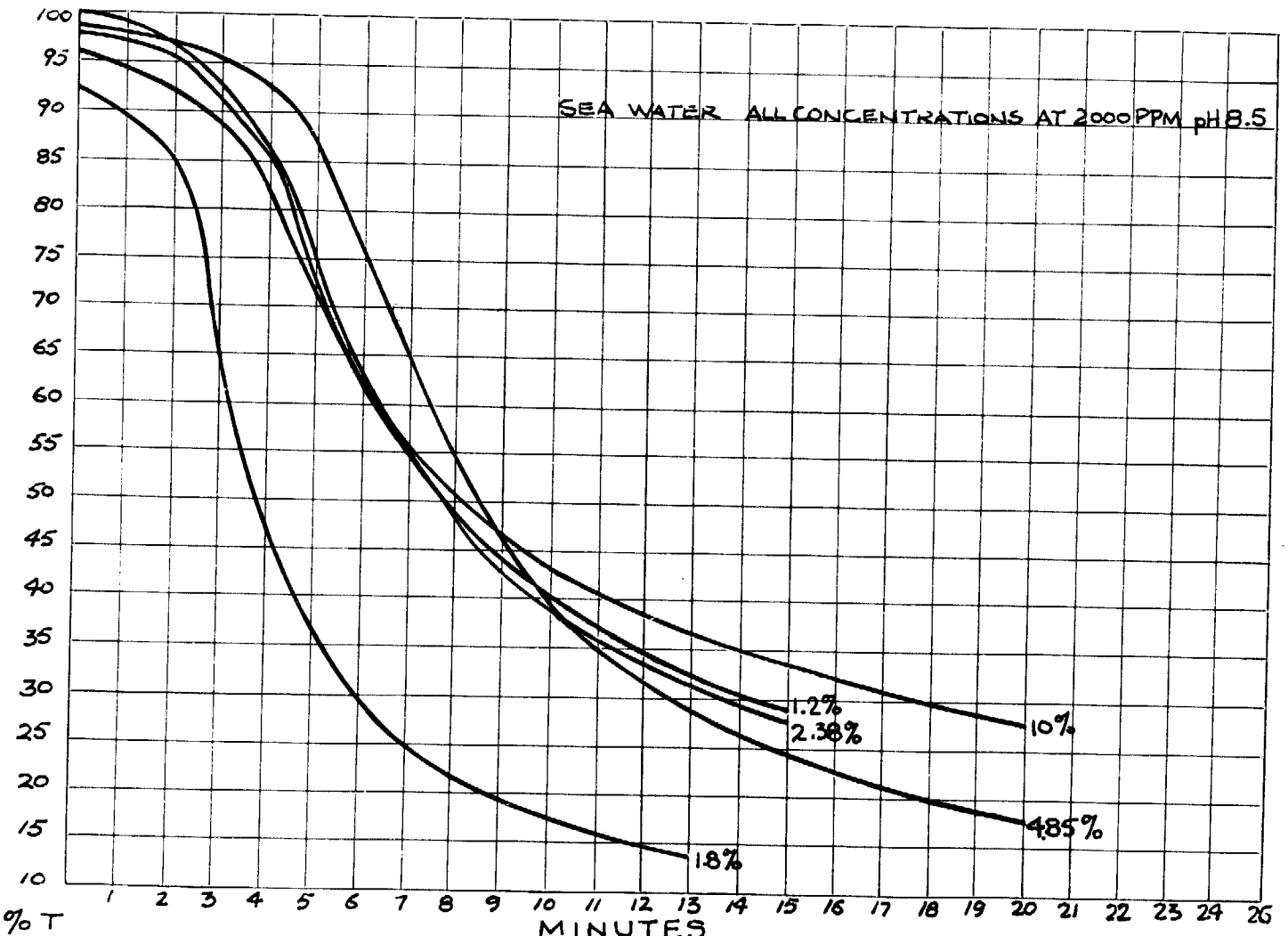

Many corrosion inhibitors which are effective in systems in which they are soluble are ineffective or less effective in systems in which they are insoluble. For example, hydrocarbon soluble corrosion inhibitors are often less effective or ineffective in aqueous systems because of their insolubility in such systems. One method of making the corrosion inhibitor soluble is to make water soluble salts of the corrosion inhibitors. However, not all corrosion inhibitors are as effective in salt form as they are in non-salt form.

I have now discovered a method of inhibiting corrosion in an aqueous system including fresh water, brine, sea water, etc., which comprises adding an aqueous insoluble corrosion inhibitor which in salt form is soluble therein, the pH of the aqueous system being sufficient to hydrolyze the salt so as to disperse the insoluble corrosion inhibitor itself as fine droplets which coat the metal with a corrosion inhibiting film.

For example, many heterocyclic amines are difficult to put into aqueous systems because of their insolubility therein. In order to render such heterocyclic amines more soluble in aqueous systems they are incorporated therein as water soluble salts.

I have now discovered that salts of such heterocyclic amines make excellent corrosion inhibitors when employed in aqueous systems having a pH above about 6. When such heterocyclic amine salts are dissolved in aqueous systems having a pH in excess of about 6, hydrolysis of the salt takes place and the heterocyclic amine itself comes out of solution as a very fine dispersion which coats the metal to be protected with a uniform tenacious corrosion inhibiting film.

The following are non-limiting examples of such heterocyclic amines: 2-methyl-3-ethylpyridine, 2-methyl-4-ehtylpyridine, 2-ethyl-3-methylpyridine, 2-ethyl-4-methylpyridine, 2-ethyl-5-methylpyridine, 2,3,5-trimethylpyridine, 2,3,5-triethylpyridine, isoquinoline and its alkyl substituted derivatives, benzoquinoline and its alkyl substituted derivatives, and phenanthridine and its alkyl substituted derivaties.

Many of the commercially available nitrogen compounds suitable for preparing the corrosion inhibitors of this invention are mixtures of the above-described heterocyclic amines, which are insoluble in aqueous systems. Alkyl pyridine residues, such as methyl ethyl pyridine residues may suitably be employed. These materials are available from the following companies under the following names.

Reilly Tar and Chemical Co.:
LAP
HAP

Allied Chemical Company:
Tar Base
Inhibitor Base
Quinoline Residue

Koppers Company:
15-18 grade base
16-20 grade base
Wet sprung high boiling base

The name "LAP" above refers to low-boiling alkylpyridines, having the following properties:
Distillation range at 760 mm., 5-95%, °C.: 172-183
Density at 20° C. g/ml: 0.924
Neutral oil, percent: 3.2
Approximate equivalent weight: 130

The name "HAP" above refers to high-boiling alkylpyridines, having the following properties: Distillation range at 760 mm.:

| | °C. |
|---|---|
| 2% | 204 |
| 5 | 207 |
| 10 | 211 |
| 20 | 218 |
| 50 | 256 |
| 70 | 323 |
| 80 | 361 |

Decomposition after 80% distilled:
Density at 20° C. g/ml: 1.003
Neutral oil, percent: 8.6
Approximate equivalent weight: 200

The name "Aklyl Pyridine R" (APR) of Union Carbide Company refers to a mixture of high boiling alkyl pyridines with an equivalent weight of about 170.

In general, acids are employed to prepare the soluble form of the corrosion inhibitor. Although theoretically any acid capable of forming water soluble salts may be employed, best results are achieved with strong acids, for example mineral acids such as hydrohalic acids, preferably HCl, sulfuric acids, sulfurous acids, sulfonic acids, carboxylic acids, etc. In fact any acid capable of forming water soluble salts which are capable of being dispersed as fine droplets upon contact with aqueous systems having a pH of about 6 or greater can be employed.

In general, the salts are prepared by neutralizing the amines, preferably to a pH of about 3.5 or lower, such as from about 3 to below about 0.1, but preferably from about 3 to about 2. The optimum pH will depend on the particular amine being neutralized.

The surfactant employed in conjunction with the corrosion inhibitor salt should be soluble or dispersible in the aqueous system. In general it is a surfactant which is water soluble or dispersible so that it enhances the dispersion of the corrosion inhibitor as it comes out of solution.

Any suitable surfactant can be employed. The surfactants which are most usually employed in the practice of this invention are oxyalkylated surfactants or more specifically polyalkylene ether or polyoxyalkylene surfactants. Oxyalkylated surfactants as a class are well known. The possible sub-classes and specific species are legion. The methods employed for the preparation of such oxyalkylated surfactants are also too well known to require much elaboration. Most of those surfactants contain, in at least one place in the molecule and often in several places, an alkanol or a polyglycolether chain. These are most commonly derived by reacting a starting molecule, possessing one or more oxyalkylatable reactive groups, with an alkylene oxide such as ethylene oxide, propylene oxide, butylene oxide, etc. However, they may be obtained by other methods such as shown in U.S. Pat. Nos. 2,588,771 and 2,596,091-3, or by esterification or amidification with an oxyalkylated material, etc. Mixtures of oxides as well as successive additions of the same or different oxides may be employed. Any oxyalkylatable material may be employed. As typical starting materials may be mentioned alkyl phenols, phenolic resins, alcohols, glycols, amines, organic acids, carbohydrates, mercaptans, and partial esters of polybasic acids. In general, the art teaches that, if the starting material is water-soluble, it may be converted into an oil-soluble surfactant by the addition of polypropoxy or polybutoxy chains. If the starting material is oil-soluble, it may be converted into a water soluble product. Subsequent additions of ethoxy units to the water-soluble surfactant by the addition of polyethoxy chains tend to increase the water solubility, while, subsequent additions of high alkoxy chains tend to increase the oil solubility. In general, the final solubility and surfactant properties are a result of a balance between the oil-soluble and water-soluble portions of the molecule.

In the practice of this invention I have found that suitable surfactants may be prepared from a wide variety of starting materials. For instance, if I begin with an oil-soluble material such as a phenol or a long chain fatty alcohol and prepare a series of products by reaction with successive portions of ethylene oxide, I find that the members of the series are successively more water-soluble. Similarly it is possible to start with water or a water-soluble material such as polyethylene glycol and add, successively, portions of propylene oxide. The members of this series will be progressively less water-soluble and more oil-soluble. There will be a preferred range where the materials are useful for the practice of this invention.

In general, the compounds which would be selected are oxyalkylated surfactants of the general formula $$Z[(OA)_nOH]_m$$

wherein Z is the oxyalkylatable material, A is the radical derived from the alkylene oxide which can be, for example, ethylene, propylene, butylene, and the like, n is a number determined by the moles of alkylene oxide reacted, for example 1 to 2000 or more and m is a whole number determined by the number of reactive oxyalkylatable groups. Where only one group is oxyalkylatable as in the case of a monofunctional phenol or alcohol R'OH, then m=1. Where Z is water, or a glycol, m=2. Where Z is glycerol, m=3, etc.

In certain cases, it is advantageous to react alkylene oxides with the oxyalkylatable material in a random fashion so as to form a random copolymer on the oxyalkylene chain, i.e., the $[(OR)_nOH]_m$ chain such as —AABAAABBABABBABBA—. In addition, the alkylene oxides can be reacted in an alternate fashion to form block copolymers on the chain, for example

—BBBAAABBBAAAABBBB— or —BBBBAAACCCAAAABBBB— where A is the unit derived from one alkylene oxide, for example ethylene oxide, and B is the unit derived from a second alkylene oxide, for example propylene oxide, and C is the unit derived from a third alkylene oxide, for example, butylene oxide, etc. Thus, these compounds include terpolymers or higher copolymers polymerized randomly or in a blockwise fashion or many variations of sequential additions.

Thus, $(OR)_n$ in the above formula can be written $—A_aB_bC_c—$ or any variation thereof, wherein a, b and c are 0 or a number provided that at least one of them is greater than 0.

It cannot be overemphasized that the nature of the oxyalkylatable starting material used in the preparation of the surfactant is not critical. Any species of such material can be employed. By proper additions of alkylene oxides, this starting material can be rendered suitable as a surfactant and its suitability can be evaluated by testing in the corrosion system.

Table I

| No. | REPRESENTATIVE EXAMPLES OF Z<br>Z |
|---|---|
| 1 | $RC(=O)—O—$ |
| 2 | 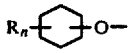 |
| 3 | R—O— |
| 4 | R—S— |
| 5 | $R—C(=O)—NH—$ |
| 6 | $R—C(=O)—N<$ |
| 7 | $R—NH—$ |
| 8 | $RN<$ |
| 9 | Phenol-aldehyde resins. |
| 10 | —O—(Ex: Alkylene oxide block polymers). |
| 11 | 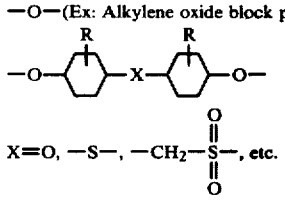 <br>X=O, —S—, $—CH_2—S(=O)_2—$, etc. |
| 12 | $R—S—CH_2C(=O)—O—$ |
| 13 | $RPO_4H$ |
| 14 | $RPO_4=$ |
| 15 | $PO_4=$ |
| 16 | 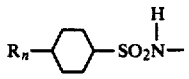 |
| 17 | 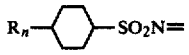 |
| 18 | $RC(=O)—NH—$ $—N<$ |
| 19 | Polyol-derived (Ex: glycerol, glucose, pentaerithrytol). |
| 20 | Anhydrohexitan or anhydrohexide derived (Spans and Tweens). |
| 21 | Polycarboxylic derived. |
| 22 | $—(CHCH_2—O)_n—$<br>$CH_2$<br>amino |

Examples of oxyalkylatable materials derived from the above radicals are legion and these, as well as other oxyalkylatable materials, are known to the art. A good source of such oxyalkylatable materials, as well as others, can be found in "Surface Active Agents and Detergents," vols. 1 and 2, by Schwartz et al., Interscience Publishers (vol. 1, 1949, vol. 2, 1958), and the patents and references referred to therein.

The following examples are presented for purposes of illustration and not of limitation.

EXAMPLE 1

Alkyl Pyridine R (APR) (Union Carbide) was neutralized to a pH of 2.5–2.9 with 33% HCl to yield the hydrochloric acid salt.

EXAMPLE 2

The APR.HCl salt of Example 1 was formulated as follows:

Table II

| Ingredient | Formulation 1 | 2 | 3 | 4 | 5 |
|---|---|---|---|---|---|
| APR . HCl | 41.2 | 41.2 | 41.2 | 41.2 | 41.2 |
| Isopropanol | 27.6 | 27.0 | 26.42 | 33.95 | 18.8 |
| *Surfactant A | 1.2 | 1.8 | 2.38 | 4.85 | 10.0 |
| Water | 30.0 | 30.0 | 30.0 | 30.0 | 30.0 |

*Surfactant A is 1 mole of tallowamine oxyethylated with 28 moles of ethylene oxide.

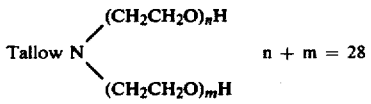

Each of these formulations, at a concentration of 2000 ppm, was added to sea water at a pH of 8.5. The effect in sea water on each formulation was observed with a Beckman Model DK-2 spectophotometer at a wave length of 1300 nonometers. The results are presented in FIG. 1 where % transmittance is plotted as a function of time (minutes).

Each of the formulations of Table II at 500 ppm was dissolved in laboratory brine 5.3% salts at pH 7.4 and the % transmittance was plotted as a function of time (minutes). The results are shown in FIG. 2.

Figure 2:
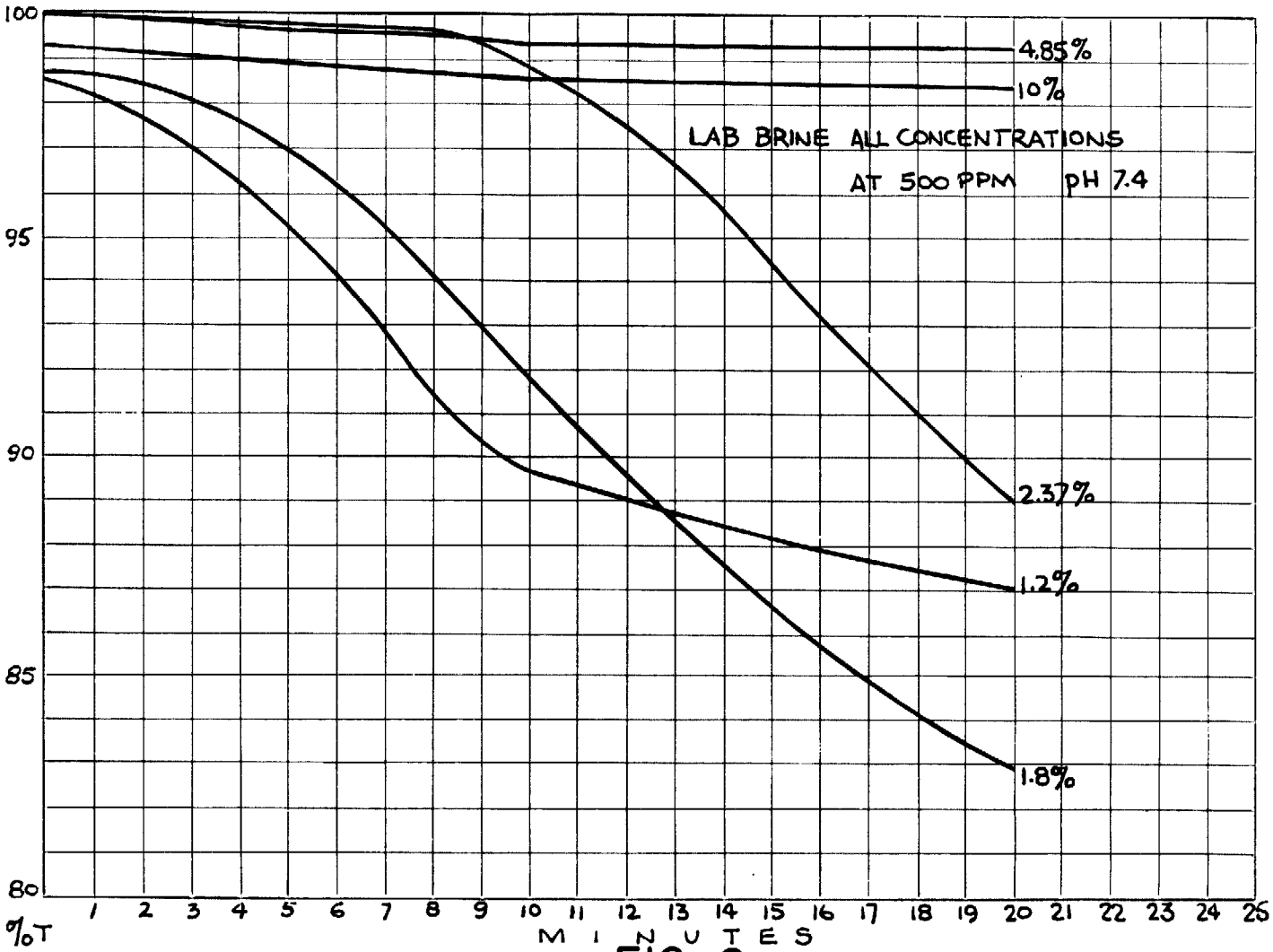

The reduction in transmittance which occurred in FIGS. 1 and 2 is a measure of opacity due to droplet precipitation of the free amine.

EXAMPLE 3

Methyl ethyl pyridine (MEP) residues were neutralized to a pH of 2.5–2.9 with 33% to yield the MEP Residues HCl salt which was employed to prepare the following formulation.

| Formulation 6 | |
|---|---|
| MEP Residual . HCl | 41.2 |
| Isopropanol | 22.0 |
| Surfactant A | 6.8 |
| Water | 30.0 |

Figure 3:
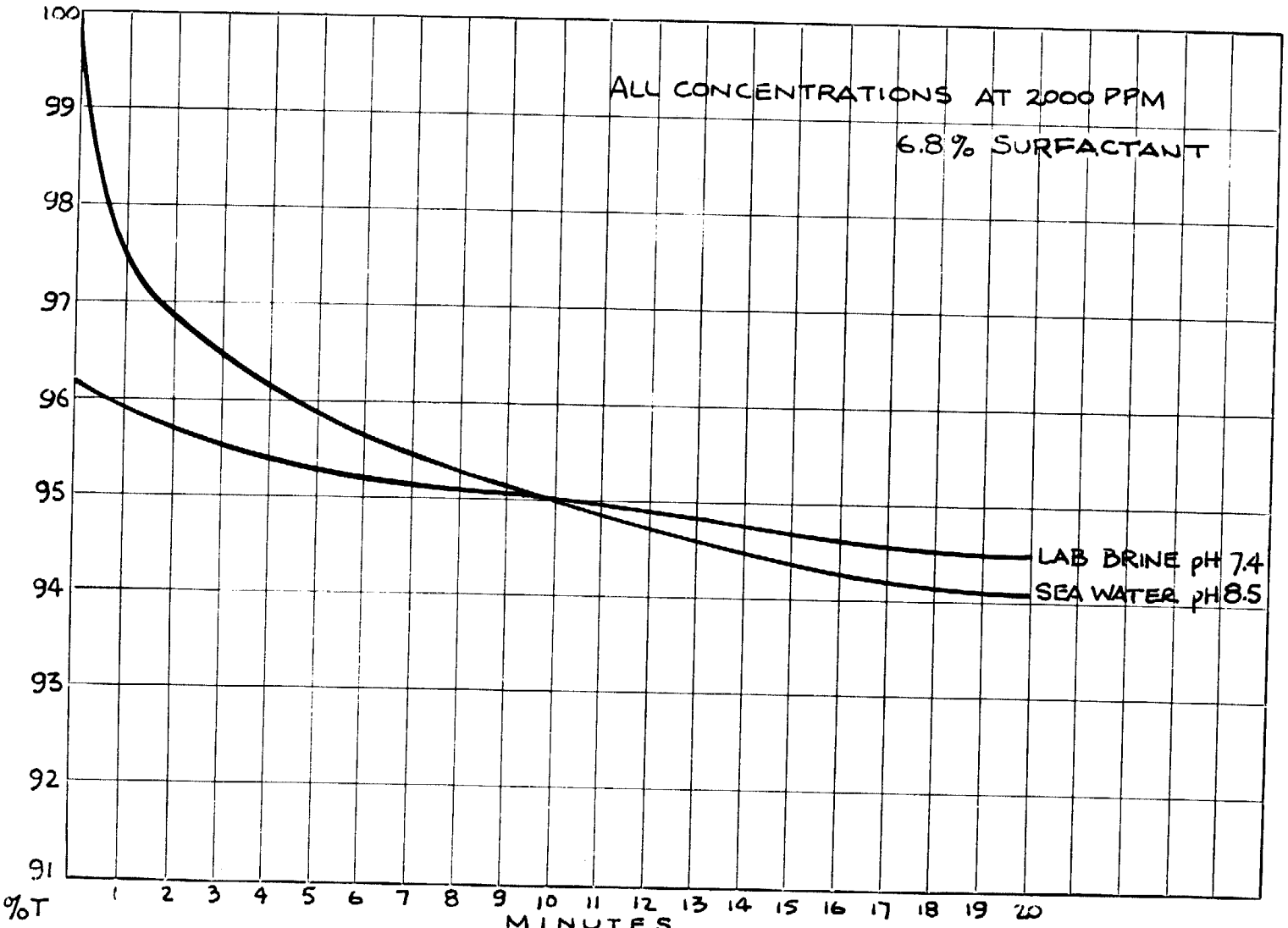

This formulation at a concentration of 2000 ppm was dissolved in laboratory brine at a pH 7.4 and sea water at a pH 8.5 and the % transmittance was plotted as a function of time in minutes. The results are presented in FIG. 3.

EXAMPLE 4

The following formulation was field tested as a corrosion inhibitor in a brine having a pH 8.6.

| Formulation 7 | |
|---|---|
| APR . HCl | 41.2 |
| Isopropanol | 21.8 |
| Surfactant A | 7.0 |

-continued

| Formulation 7 | |
|---|---|
| Water | 30.0 |

The results are as follows at a concentration of 50 ppm. Measurements were on 1020 mild steel coupons employed as electrodes, employing the PAIRMETER and process described in U.S. Pat. No. 3,406,101.

Table III

| Time Hrs. | MPY Blank | Precorroded for 6 Hrs. Then inhibited | Fresh Inhibitor |
|---|---|---|---|
| 1 | 62 | 1.8 | 2.0 |
| 2 | 58 | 0.6 | 1.8 |
| 4 | 54 | 0.5 | 1.0 |
| 5 | 52 | 0.3 | 0.8 |
| 6 | 52 | 0.3 | 0.5 |

The above data illustrates the following:

(1) that upon solution in water the free base comes out of solution as a fine dispersion.

(2) that the amount of dispersion is a function of the aqueous system, i.e., salt content.

(3) that the amount of dispersion is also a function of the amount of surfactant.

(4) that the dispersion is a very effective corrosion inhibitor.

In the above tests the concentration of the inhibitor employed was high in order to magnify the effect of opacity. In practice the concentration employed will vary depending on many factors such as with the inhibitor, the system, etc. In general one employs from about 1 to 10,000 ppm, for example from about 3 to 1,000 ppm, such as from about 5 to 250 ppm, but preferably from about 10–150 ppm with an optimum of about 15 to 75 ppm.

The particular surfactant employed will vary depending on the corrosion inhibitor, the system, etc. In general, an effective amount of surfactant is employed, for example from about 0.1 to 50% or more, such as from about 0.5 to 25%, for example from about 0.75 to 10, but preferably from about 1 to 2%, with an optimum of about 5% to 7% by weight of the inhibitor formulation (40–50% active).

By employing the process of this invention, the heterocyclic amine is precipitated from a solution of heterocyclic amine salt as a fine dispersion which coats or "plates" the metal to be protected with a tenacious corrosion inhibiting film.

The process can be applied to any aqueous containing system including fresh water, brines, sea water, etc., particularly those containing iron, steel or ferrous alloys, etc. In the petroleum industry it can be applied in primary production in oil, gas, and condensate wells, in secondary or tertiary production including water flooding, waste water treatment and disposal, etc., in the refining of petroleum, in distillation, overhead systems, transmission lines, etc.

While the specific examples have been set forth hereinabove, it is not intended to limit the invention solely thereto, but to include all variations and modifications within the spirit of this invention. For example, surfactants other than oxyalkylated can be employed, for example sulfonates, carboxylates, phosphonates, etc.

I claim:

1. A process of inhibiting corrosion of metals by an aqueous system which comprises adding an aqueous soluble hydrohalic, sulfuric, sulfurous or carboxylic acid salt of a normally water insoluble heterocyclic amine to such an aqueous system having a pH above about 6, which converts said salt to the free amine, which coats the metal with a corrosion inhibiting film.

2. The process of claim 1 where said normally water insoluble heterocyclic amine is an alkyl pyridine.

3. The process of claim 2 employed in conjunction with a surfactant.

4. The process of claim 1 employed in conjunction with a surfactant.

5. A process of inhibiting corrosion of metals by an aqueous system which comprises adding a composition comprising water, isopropanol, a surfactant and an aqueous soluble salt of a water insoluble corrosion inhibitor to such an aqueous system having a pH above about 6, which converts said salt to an insoluble form which coats the metal with a corrosion inhibiting film.

6. The process of claim 5 wherein said salt is a salt of a heterocyclic amine.

7. The process of claim 6 where said heterocyclic amine is an alkyl pyridine.

8. The process of claim 5 where said water insoluble corrosion inhibitor is an alkyl pyridine residue.

9. A process of inhibiting corrosion of metals by an aqueous system which comprises adding an aqueous soluble hydrohalic, sulfuric, sulfurous or carboxylic acid salt of a normally water insoluble alkyl pyridine residue to such an aqueous system having a pH above about 6, which converts said salt to the free amines, which coat the metal with a corrosion inhibiting film.

10. The process of claim 9 where said alkyl pyridine residue is a methyl ethyl pyridine residue.

11. The process of claim 10 employed in conjunction with a surfactant.

12. The process of claim 9 employed in conjunction with a surfactant.

13. A process of inhibiting corrosion of metals by an aqueous system which comprises adding an aqueous soluble hydrohalic, sulfuric, sulfurous or carboxylic acid salt of a mixture of low boiling alkyl pyridines having the following properties:

Distillation range at 760 mm., 5–95%, °C.: 172–183
Density at 20° C. g/ml: 0.924
Neutral oil, percent: 3.2
Approximate equivalent weight: 130 to such an aqueous system having a pH above about 6, which converts said salt to the free amines which coat the metal with a corrosion inhibiting film.

14. A process of inhibiting corrosion of metals by an aqueous system which comprises adding an aqueous soluble hydrohalic, sulfuric, sulfurous or carboxylic acid salt of a mixture of high boiling alkyl pyridines having the following properties:

| | °C. |
|---|---|
| 2% | 204 |
| 5 | 207 |
| 10 | 211 |
| 20 | 218 |
| 50 | 256 |
| 70 | 323 |
| 80 | 361 |

Decomposition after 80% distilled:
Density at 20° C. g/ml: 1.003
Neutral oil, percent: 8.6
Approximate equivalent weight: 200
to such an aqueous system having a pH above about 6, which converts said salt to the free amines which coat the metal with a corrosion inhibiting film.

15. A process of inhibiting corrosion of metals by an aqueous soluble hydrohalic, sulfuric, sulfurous or carboxylic acid salt of a mixture of high boiling alkyl pyridines with an equivalent weight of about 170 to such an aqueous system having a pH above about 6, which converts said salt to the free amines which coat the metal with a corrosion inhibiting film.

16. The process of claim 15 employed in conjunction with a surfactant.

* * * * *